US007413289B2

(12) United States Patent
Cornell et al.

(10) Patent No.: US 7,413,289 B2
(45) Date of Patent: Aug. 19, 2008

(54) LOW ENERGY, LONG LIFE MICRO-FLUID EJECTION DEVICE

(75) Inventors: Robert W. Cornell, Lexington, KY (US); James Harold Powers, Lexington, KY (US); Shirish Padmakar Mulay, Lexington, KY (US); Robert L. Cornell, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 430 days.

(21) Appl. No.: 11/317,575

(22) Filed: Dec. 23, 2005

(65) Prior Publication Data

US 2007/0146436 A1 Jun. 28, 2007

(51) Int. Cl.
*B41J 2/05* (2006.01)

(52) U.S. Cl. ..... 347/63; 347/56; 347/64

(58) Field of Classification Search ..... 347/20, 347/44, 47, 56, 61–65, 67
See application file for complete search history.

(56) References Cited

U.S. PATENT DOCUMENTS 4,794,411 A * 12/1988 Taub et al. ..... 347/47
5,831,648 A 11/1998 Mitani et al. ..... 347/62
6,161,924 A 12/2000 Mitani et al. ..... 347/64
7,070,262 B2 * 7/2006 Yamamoto et al. ..... 347/63
2005/0012791 A1 1/2005 Anderson et al. ..... 347/85

* cited by examiner

*Primary Examiner*—Juanita D Stephens
(74) *Attorney, Agent, or Firm*—Luedeka, Neely & Graham, PC

(57) ABSTRACT

Micro-fluid ejection heads and methods for extending the life of micro-fluid ejection heads. One such micro-fluid ejection head includes a substrate having a plurality of thermal ejection actuators. Each of the thermal ejection actuators has a resistive layer and a protective layer thereon. A flow feature member is adjacent the substrate and defines a fluid feed channel, a fluid chamber associated with at least one of the actuators and in flow communication with the fluid feed channel, and a nozzle. The nozzle is offset to a side of the chamber opposite the feed channel. A polymeric layer having a degradation temperature of less than about 400° C. overlaps a portion of the at least one actuator associated with the fluid chamber and positioned less than about five microns from at least an edge of the at least one actuator opposite the fluid feed channel.

20 Claims, 8 Drawing Sheets

LOW ENERGY, LONG LIFE MICRO-FLUID EJECTION DEVICE

FIELD OF THE DISCLOSURE

The disclosure relates to micro-fluid ejection devices and in one particular embodiment, to low energy, long life devices for ejecting small liquid droplets.

BACKGROUND AND SUMMARY

Micro-fluid ejection devices are classified by a mechanism used to eject fluid. Two of the major types of micro-fluid ejection devices include thermal actuators and piezoelectric actuators. Thermal actuators rely on an ability to heat the fluid to a nucleation temperature wherein a gas bubble is formed that expels the fluid through a nozzle. The life of such thermal actuators is dependent on a number of factors including, but not limited to, dielectric breakdown, corrosion, fatigue, electromigration, contamination, thermal mismatch, electro static discharge, material compatibility, delamination, and humidity, to name a few. A heater resistor used in a micro-fluid ejection device may be exposed to all of these failure mechanisms.

For example, it is well-known that cavitation pressures are powerful enough to pound thru any solid material, from concrete dams to ship propellers. During each fire cycle, the heater resistor may be exposed to similar cavitation impacts. As the gas bubble collapses, a local pressure is generated on the order of $10^3$ to $10^4$ atmospheres. Such cavitation impacts may be focused on a submicron spot of the heater resistor for several nanoseconds. After $10^7$ to $10^8$ cavitation impacts, the heater resistor may fail due to mechanical erosion. Furthermore, because the heater resistor requires extremely high temperatures to ensure homogeneous bubble nucleation, a distortion energy in the heater due to thermal expansion may be generated of the same order of magnitude as the distortion energy imposed by bubble collapse. A combination of thermal expansion and cavitation impacts may lead to premature heater failure.

In order to protect the fragile heater resistor films, the films may be hermitically sealed to prevent humidity driven corrosion, but the surface of the heater resistor is directly exposed to liquid. In the most critical areas of the heater, a minor surface opening due to defect, wear, step coverage, or delamination may lead to catastrophic failure of the heater resistor.

Accordingly, exotic resistor films and multiple protective layers providing a heater stack are used to provide heater resistors robust enough to withstand the cavitation and thermal expansion abuses described above. However, the overall thickness of the heater stack should be minimized because input energy is a linear function of heater stack thickness. In order to provide competitive actuator devices from a power dissipation and production throughput perspective, the heater stack should not be arbitrarily thickened to mitigate the cavitation effects, overcome step coverage issues, overcome delamination problems, reduce electro static discharge, etc. In other words, improved heater resistor reliability by overdesign of the thin film resistive and protective layers may produce a noncompetitive product.

Micro-fluid ejection heads may be classified as permanent, semi-permanent or disposable. The protective films used on the heater resistors of disposable micro-fluid ejection heads need only survive until the fluid in the attached fluid cartridges is exhausted. Installation of a fluid cartridge carries with it the installation of a new micro-fluid ejection head. A more difficult problem of heater resistor life is presented for permanent or semi-permanent micro-fluid ejection heads. There is a need, therefore, for a method and apparatus for improving heater resistor life without sacrificing jetting metrics and power consumption.

With regard to the above, exemplary embodiments of the disclosure provide micro-fluid ejection heads having extended life and relatively low energy consumption and methods of making a micro-fluid ejection heads with extended life and relatively low energy consumption. One such micro-fluid ejection head includes a substrate having a plurality of thermal ejection actuators disposed thereon. Each of the thermal ejection actuators includes a resistive layer and a protective layer for protecting a surface of the resistive layer. The resistive layer and the protective layer together define an actuator stack thickness. A flow feature member is adjacent (e.g., attached to) the substrate and defines a fluid feed channel, a fluid chamber associated with at least one of the thermal ejection actuators and in flow communication with the fluid feed channel, and a nozzle. The nozzle is offset to a side of the fluid chamber opposite the fluid feed channel. A polymeric layer having a degradation temperature of less than about 400° C. overlaps a portion of the at least one thermal ejection actuator, and positioned less than about five microns from at least an edge of the at least one actuator opposite the fluid feed channel.

In another embodiment there is provided a method for extending a life of a thermal ejection actuator for a micro-fluid ejection head. A substrate has a plurality of thermal ejection actuators and a protective layer therefor deposited thereon, and has a flow feature member defining a fluid feed channel, a fluid chamber associated with at least one of the thermal ejection actuators and in flow communication with the fluid feed channel, and a nozzle. The nozzle is offset to a side of the fluid chamber distal from the fluid feed channel. The method comprises depositing a polymeric layer having a degradation temperature of less than about 400° C. in overlapping relationship with at least a portion of the at least one thermal ejection actuator. The polymeric layer overlaps less than about five microns of the at least one actuator adjacent an edge thereof distal from the fluid feed channel.

An advantage of at least some of the exemplary embodiments of the disclosure is that heater energy is not increased while the life of the actuators is substantially enhanced. Another potential advantage of at least some of the disclosed embodiments is an ability to vary the life of an ejection actuator without significantly changing the energy requirements for ejecting fluids.

BRIEF DESCRIPTION OF THE DRAWINGS

Further advantages of the embodiments will become apparent by reference to the detailed description of exemplary embodiments when considered in conjunction with the drawings, wherein like reference characters designate like or similar elements throughout the several drawings as follows.

DETAILED DESCRIPTION OF EXEMPLARY EMBODIMENTS

In accordance with embodiments described herein, micro-fluid ejection heads having improved energy consumption and extended life will now be described.

For the purposes of this disclosure, the terms "heater stack", "ejector stack", and "actuator stack" are intended to refer to an ejection actuator having a combined layer thickness of a resistive material layer and passivation or protection material layer. The passivation or protection material layer is applied to a surface of the resistive material layer to protect the actuator from, for example, chemical or mechanical corrosion or erosion effects of fluids ejected by the micro-fluid ejection device.

Figure 1:
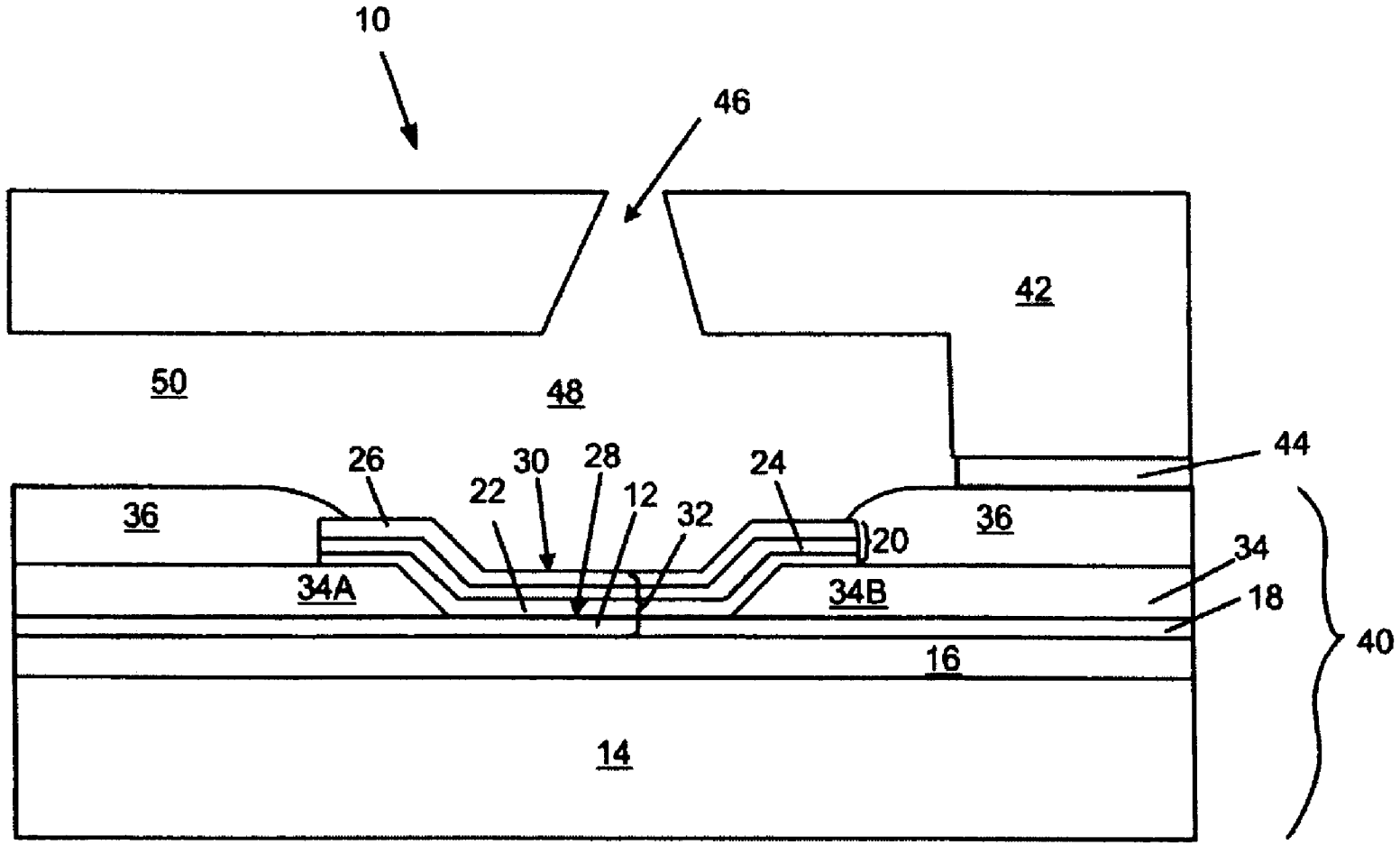
FIG. 1 Prior Art
FIG. 1 is a cross-sectional view, not to scale, of a portion of a prior art micro-fluid ejection head.

In order to more fully appreciate the benefits of the exemplary embodiments, reference is first made to FIG. 1, which is a cross-sectional view, not to scale, of a portion of a prior art micro-fluid ejection head 10. The cross-sectional view of FIG. 1 shows one of many micro-fluid ejection actuators 12 contained on a micro-fluid ejection head. The ejection actuators 12 are formed on a substrate 14. The substrate 14 may be made from a wide variety of materials including plastics, ceramics, glass, silicon, semiconductor material, and the like. In the case of a semiconductor material substrate, a thermal insulating layer 16 is applied to the substrate between the substrate 14 and the ejection actuators 12. The ejection actuators 12 may be formed from an electrically resistive material layer 18, such as TaAl, $Ta_2N$, TaAl(O,N), TaAlSi, TaSiC, Ti(N,O), WSi(O,N), TaAlN, and TaAl/Ta. The thickness of the resistive material layer 18 may range from about 300 to about 1000 Angstroms.

The thermal insulation layer 16 may be formed from a thin layer of silicon dioxide and/or doped silicon glass overlying the relatively thick substrate 14. The total thickness of the thermal insulation layer 16 may range from about 1 to about 3 microns thick. The underlying substrate 14 may have a thickness ranging from about 0.2 to about 0.8 millimeters thick.

A protective layer 20 overlies the micro-fluid ejection actuators 12. The protective layer 20 may be a single material layer or a combination of several material layers. In the illustration in FIG. 1, the protective layer 20 includes a first passivation layer 22, a second passivation layer 24, and a cavitation layer 26. The protective layer 20 is effective to prevent the fluid or other contaminants from adversely affecting the operation and electrical properties of the fluid ejection actuators 12 and provides protection from mechanical abrasion or shock from fluid bubble collapse.

The first passivation layer 22 may be formed from a dielectric material, such as silicon nitride, or silicon doped diamond-like carbon (Si-DLC) having a thickness ranging from about 1000 to about 3200 Angstroms thick. The second passivation layer 24 may also be formed from a dielectric material, such as silicon carbide, silicon nitride, or silicon-doped diamond-like carbon (Si-DLC) having a thickness ranging from about 500 to about 1500 Angstroms thick. The combined thickness of the first and second passivation layers 22 and 24 typically ranges from about 1000 to about 5000 Angstroms.

The cavitation layer 26 is typically formed from tantalum having a thickness greater than about 500 Angstroms thick. The cavitation layer 26 may also be made of TaB, Ti, TiW, TiN, WSi, or any other material with a similar thermal capacitance and relatively high hardness. The maximum thickness of the cavitation layer 26 is such that the total thickness of protective layer 20 is less than about 7200 Angstroms thick. The total thickness of the protective layer 20 is defined as a distance from a top surface 28 of the resistive material layer 18 to an outermost surface 30 of the protective layer 20. An ejector stack thickness 32 is defined as the combined thickness of layers 18 and 20.

The ejection actuator 12 is defined by depositing and etching a metal conductive layer 34 on the resistive layer 18 to provide power and ground conductors 34A and 34B as illustrated in FIG. 1. The conductive layer 34 is typically selected from conductive metals, including but not limited to, gold, aluminum, silver, copper, and the like and has a thickness ranging from about 4,000 to about 15,000 Angstroms.

Overlying the power and ground conductors 34A and 34B is another insulating layer or dielectric layer 36 typically composed of epoxy photoresist materials, polyimide materials, silicon nitride, silicon carbide, silicon dioxide, spun-on-glass (SOG), laminated polymer and the like. The insulating layer 36 and has a thickness ranging from about 5,000 to about 20,000 Angstroms and provides insulation between a second metal layer and conductive layer 34 and corrosion protection of the conductive layer 34.

Layers 14, 16, 18, 20, 34, and 36 provide a semiconductor substrate 40 for use in the micro-fluid ejection head 10. A nozzle plate 42 is adjacent (e.g., attached, as by an adhesive 44 to) the semiconductor substrate 40. In the prior art embodiment illustrated in FIG. 1, the nozzle plate 42 contains nozzles 46 corresponding to respective ones of the plurality of ejection actuators 12. During a fluid ejection operation, a fluid in fluid chamber 48 is heated by the ejection actuators 12 to a nucleation temperature of about 325° C. to form a fluid bubble which expels fluid from the fluid chamber 48 through the nozzles 46. A fluid supply channel 50 provides fluid to the fluid chamber 48.

One disadvantage of the micro-fluid ejection head 10 described above is that the multiplicity of protective layers 20 within the micro-fluid ejection head 10 increases the ejection stack thickness 32, thereby increasing an overall jetting energy required to eject a drop of fluid through the nozzles 46.

Upon activation of the ejection actuator 12, some of the energy ends up as waste heat energy used to heat the protective layer 20 via conduction, while the remainder of the energy is used to heat the fluid adjacent the surface 30 of the cavitation layer 26. When the surface 30 reaches a fluid superheat limit, a vapor bubble is formed. Once the vapor bubble is formed, the fluid is thermally disconnected from the surface 30. Accordingly, the vapor bubble prevents further thermal energy transfer to the fluid.

Figure 2:
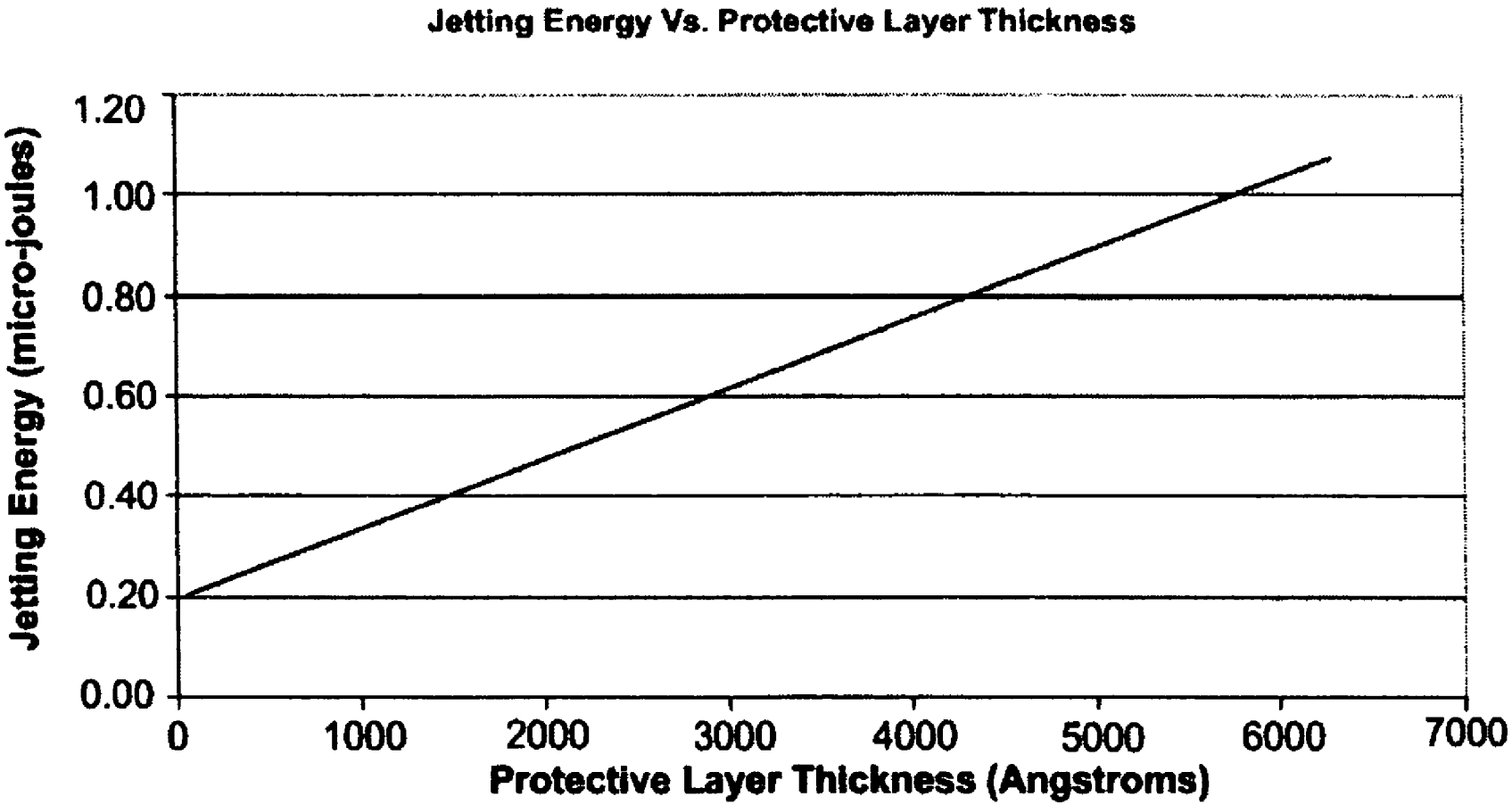
FIG. 2 is a graphical representation of jetting energy versus protective layer thickness for micro-fluid ejection heads.

It is the thermal energy transferred into the fluid, prior to bubble formation, that drives the liquid-vapor change of state of the fluid. Since thermal energy must pass through the protective layer 20 before heating the fluid, the protective layer 20 is also heated. It takes a finite amount of energy to heat the protective layer 20. The amount of energy required to heat the protective layer 20 is directly proportional to the thickness of the protective layer 20 and the thickness of the resistive layer 18. An illustrative example of the relationship between the protective layer 20 thickness and jetting energy requirement for a specific ejection actuator 12 size is shown in FIG. 2.

Jetting energy is related to power (power being the product of energy and firing frequency of the micro-fluid ejection actuators 12). The temperature rise experienced by the substrate 40 is also related to power. Adequate jetting performance and fluid characteristics, such as print quality in the case of an ink ejection device, are related to the temperature rise of the substrate 40.

For disposable micro-fluid ejection heads, the thickness of the protective layer 20 may be minimized in order to reduce power consumption. However, for longer life micro-fluid ejection heads, such as permanent or semi-permanent ejection heads, increasing the protective layer 20 thickness to extend the life of the ejection heads may adversely affect the power consumption of the ejection heads as described above. For example, a disposable ejection head may provide up to about 10 million ejection cycles before failure of the ejection head. However, longer life ejection heads may require up to 1 billion ejection cycles or more before failure. Accordingly, methods and apparatus for extending the life of the ejection heads without adversely affecting the ejection energy requirements may be provided, such as by the following exemplary embodiments.

Figure 3:
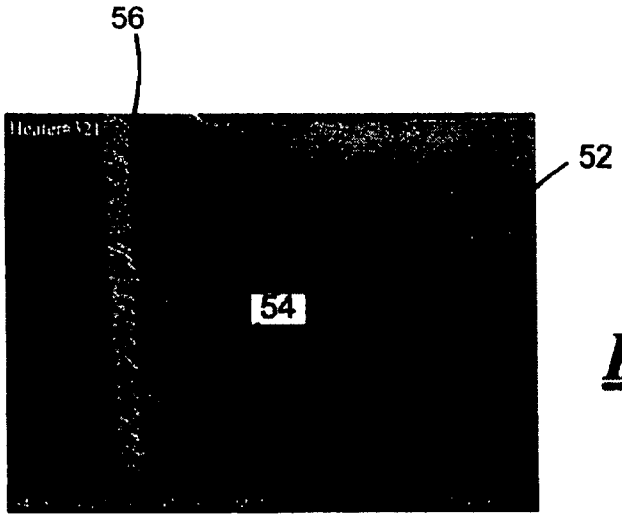
FIG. 3 Prior Art
FIG. 3 is photomicrograph plan view of a prior art micro-fluid ejection actuator having cavitation damage thereon.
Figure 4:
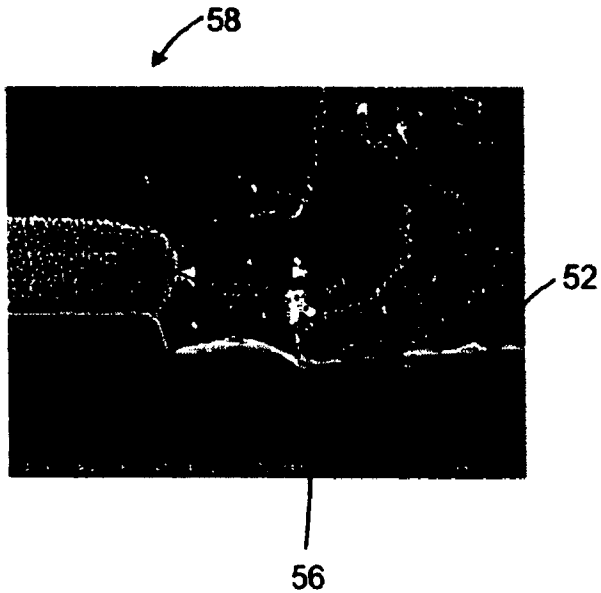
FIG. 4 Prior Art
FIG. 4 is a photomicrograph cross-sectional view of a prior art micro-fluid ejection actuator having cavitation damage thereon.

As described above, thermal expansion distortions and cavitation impacts combine to reduce the life of micro-fluid ejection actuators. Evidence of the destructive effects of cavitation and thermal expansion may be seen in the photomicrographs of a prior art micro-fluid ejection actuator illustrated in FIGS. 3 and 4. FIG. 3 is a plan view of a prior art micro-fluid ejection actuator 52 showing a wear pattern 54 adjacent an edge 56 distal from the fluid supply channel 50 (FIG. 1). FIG. 4 is a cross-sectional view of a prior art micro-fluid ejection head 58 showing the erosion pattern adjacent the edge 56 of the micro-fluid ejection actuator 52.

Figure 5:
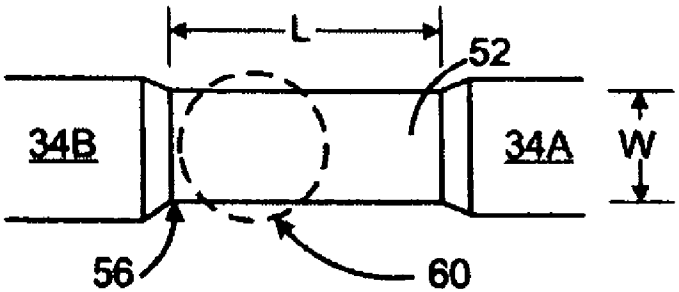
FIG. 5 Prior Art
FIG. 5 is a plan view, not to scale, of a portion of a prior art micro-fluid ejection head.

As shown more clearly in FIG. 5, the prior art micro-fluid ejection actuator 52 is an elongate heater resistor have a length L greater than a width W. Typically the actuator 52 has a length to width ratio ranging from about 1.5:1 to about 3:1. The overall heating area of the actuator 52 may range from about 200 square microns to about 1200 square microns.

A nozzle 60 can be biased toward the distal edge 56 of the micro-fluid ejection actuator 52, such as in order to reduce air entrapment in the fluid chamber 48 (FIG. 1). However, biasing the nozzle 60 toward the distal edge 56 increases the cavitation and thermal expansion damage adjacent the distal edge 56 of the micro-fluid ejection actuator, as shown in FIGS. 3 and 4.

Figure 6:
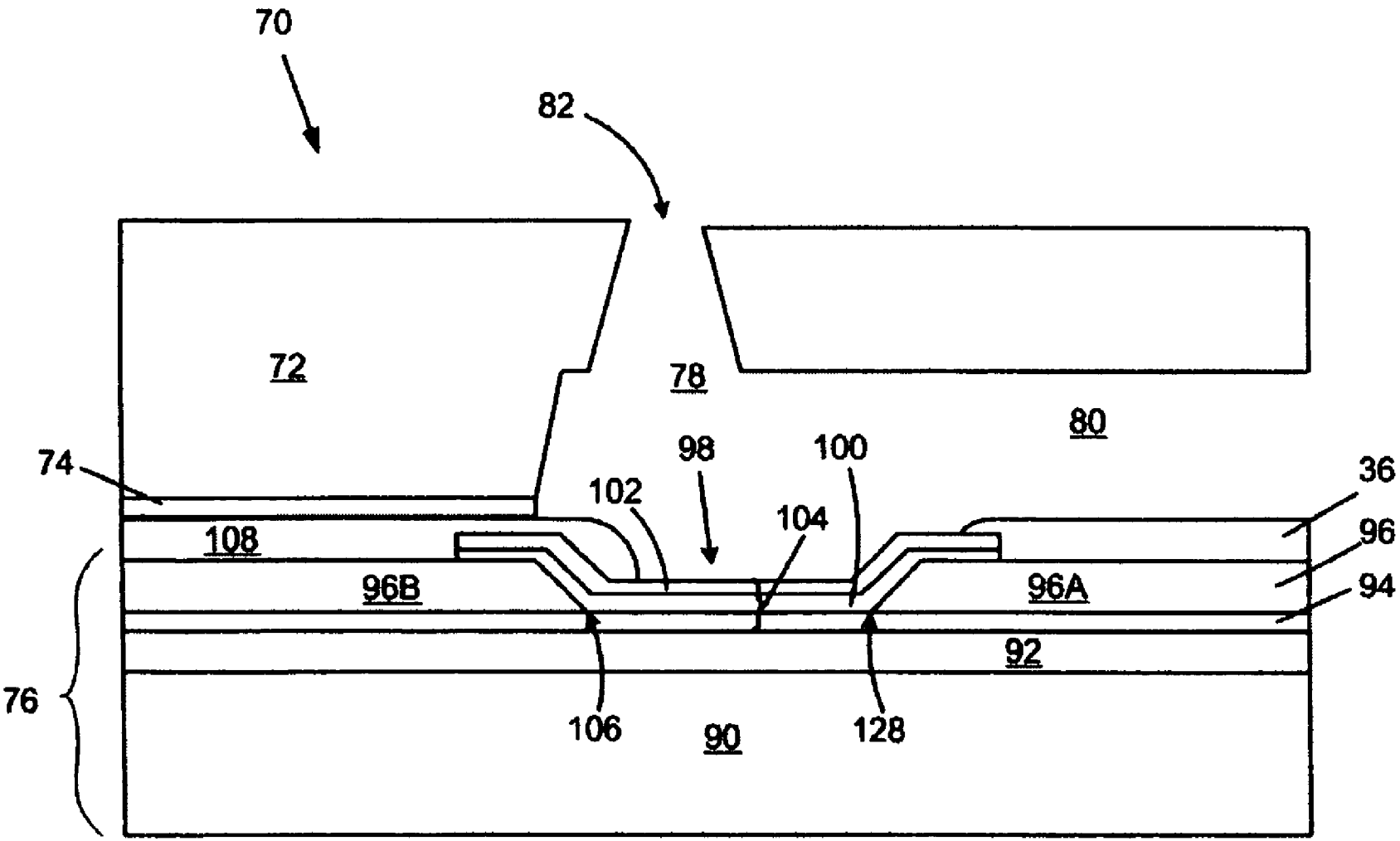
FIG. 6 is a cross-sectional view, not to scale, of a portion of a micro-fluid ejection head according to a first embodiment of the disclosure.

Methods and apparatus for reducing or eliminating thermal expansion and cavitation damage to micro-fluid ejection actuators will now be described with reference to FIGS. 6-9. FIG. 6 is a cross-sectional view, not to scale, of a micro-fluid ejection head 70 according to a first embodiment of the disclosure. In this embodiment, the ejection head 70 includes a flow feature member 72 attached, as by an adhesive 74, adjacent (e.g., to) a semiconductor substrate 76. The flow feature member 72 has a thickness ranging from about 5 to 65 microns, and can be made from a chemically resistant polymer such as polyimide. Flow features, such as a fluid chamber 78, fluid supply channel 80 and nozzle 82, can be formed in the flow feature member 72 by conventional techniques, such as laser ablation. The embodiments described herein are not limited by the foregoing flow feature member 72. In an alternative embodiment, the flow feature member may comprise fluid chambers and the fluid supply channel in a thick film layer to which a nozzle plate is attached, or the flow features may be formed in both a thick film layer and a nozzle plate. FIG. 9, described below, illustrates an embodiment of a micro-fluid ejection head 84 having a thick film layer 86 and nozzle plate 88 attached to the thick film layer 86.

The semiconductor substrate 76 to which the flow feature member 72 is attached includes a support substrate 90 made of an insulating or semiconductive material as described above with reference to FIG. 1. In the case of a semiconductive material for substrate 90, an insulating layer 92 similar to layer 16 is applied to the substrate 90. A resistive layer 94 similar to resistive layer 18, described above, is applied to the insulating layer 92. Likewise, a conductive layer 96 similar to conductive layer 34 is applied to the resistive layer 94 and is etched to provide the power and ground conductors 96A and 96B for activating a micro-fluid ejection actuator 98 defined between the conductors 96A and 96B.

An advantage of at least some of the disclosed embodiments is that a number and thickness of protective layers for the micro-fluid ejection actuator 98 may be reduced in order to reduce power consumption without adversely affecting the life of the micro-fluid ejection actuators 98.

Unlike the ejection head 10 illustrated in FIG. 1, the ejection head 70 has a single protective layer 100 and, optionally, a relatively thin cavitation layer 102. The protective layer 100 may be provided by a material selected from the group consisting of diamond-like carbon (DLC), silicon doped diamond-like carbon (Si-DLC) titanium, tantalum, silicon nitride and an oxidized metal. The thickness of the protective layer 100 may range from about 400 to about 3000 Angstroms. Such a protective layer 72 thickness provides an ejection actuator stack 104 having a thickness ranging from about 1200 to about 6500 Angstroms. When used, the cavitation layer 102 may have a thickness ranging from about 500 to about 3000 Angstroms.

Figure 7:
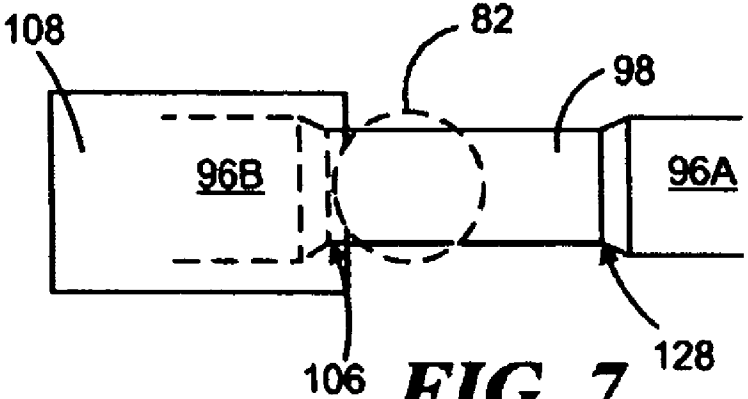
FIG. 7 is a plan view, not to scale, of a portion of a micro-fluid ejection head according to the first embodiment of the disclosure.

In order to, for example, reduce damage caused by thermal expansion and cavitation adjacent a distal edge 106 of the micro-fluid ejection actuator 98, a polymeric layer 108 having a degradation temperature of less than about 400° C. is applied to the protective layers 100 and 102 and conductive layer 96 so that the polymeric layer overlaps a portion of the micro-fluid ejection actuator 98 as shown in plan view in FIG. 7 adjacent the distal edge 106 thereof. Due to the relatively low degradation temperature of the polymeric layer 108, the overlapped portion of the actuator 98 should be less than about five microns. Typically, the overlapped portion of the actuator 98 will range from about one to about four microns.

Figure 8:
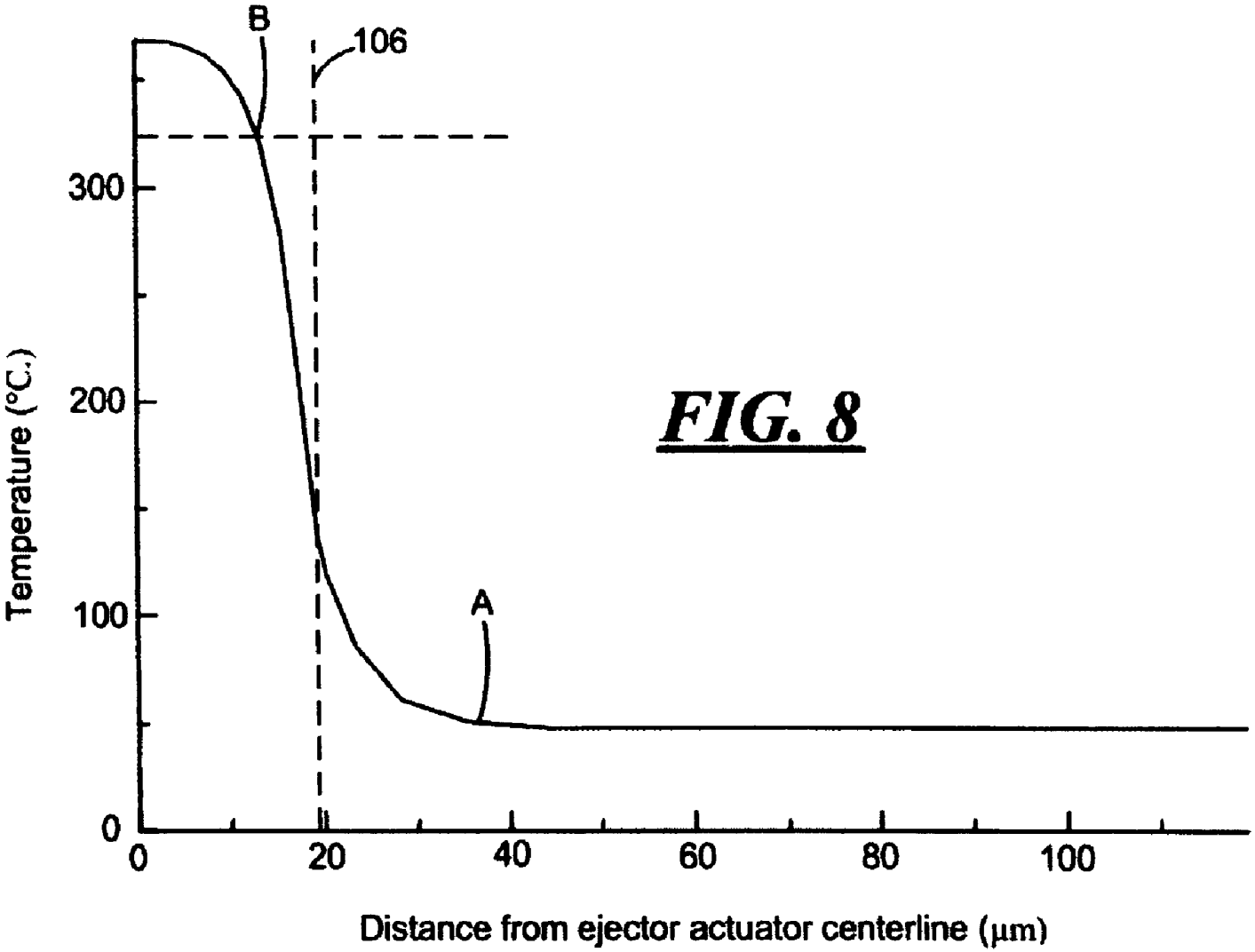
FIG. 8 is temperature profile for a micro-fluid ejection actuator according to the disclosure.
Figure 9:
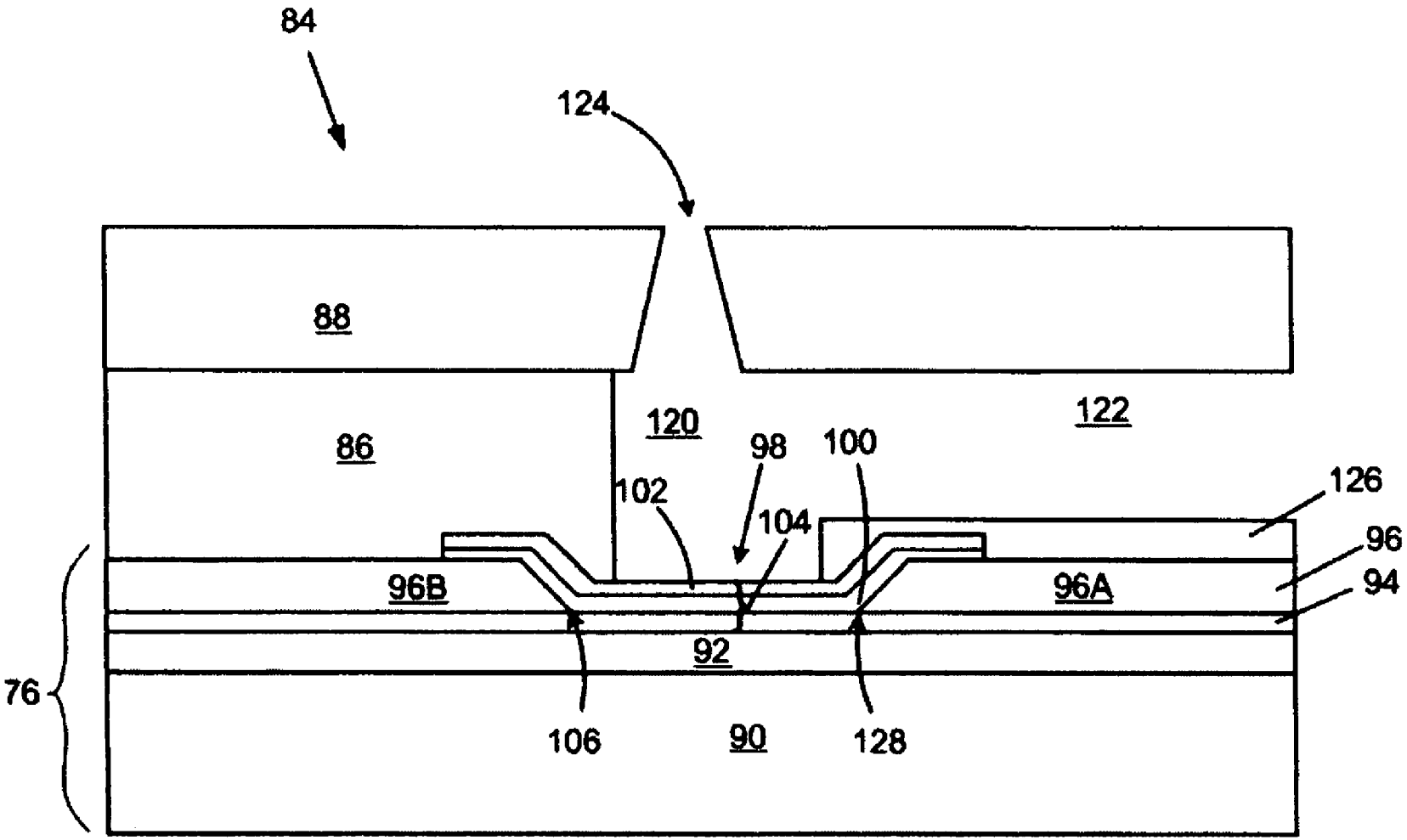
FIG. 9 is a cross-sectional view, not to scale, of a portion of a micro-fluid ejection head according to a second embodiment of the disclosure.

A temperature profile for the micro-fluid ejection actuator 98 is shown by Curve A in FIG. 8. As shown in FIG. 8, the micro-fluid ejection actuator 98 has a temperature of about 400° C. in a central portion of the actuator whereas, the edge 106 of the actuator has a temperature of about 150° C. At about five microns from the edge 106 of the actuator 98, point B on Curve A, the temperature is about 325° C. which is the nucleation temperature indicated by dashed line 110 for ejecting fluid from the micro-fluid ejection head 70. Accordingly, if less than five microns of the actuator 98 adjacent edge 106 is overlapped with the polymeric layer 108, the polymeric layer may be below its decomposition temperature.

A suitable polymeric layer 108 having a degradation temperature below about 400° C. is a cross-linked epoxy material such as described in U.S. Pat. No. 6,830,646 to Patil et al., the disclosure of which is incorporated herein by reference. The polymeric layer 108, in the case of micro-fluid ejection head 70, may be applied as a planarization layer having a thickness averaging from about one to about ten microns. Spin coating, spraying, dipping, or roll coating processes may be used to apply the polymeric layer 108 to the conductive layer 96 and protective layers 100 and 102. It will be appreciated that the overlapped portion of the actuator 98 may have a greater thickness of polymeric layer 108 so that a relatively smooth planarization layer may be obtained.

Figure 10:
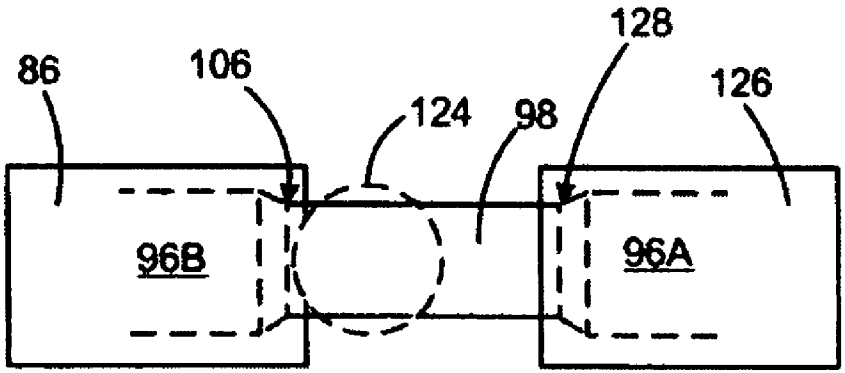
FIG. 10 is a plan view, not to scale, of a portion of a micro-fluid ejection head according to the second embodiment of the disclosure.

With reference now to FIGS. 9 and 10, alternate embodiments of the disclosure will now be described. As set forth above, the micro-fluid ejection head 84 illustrated in FIGS. 9 and 10 includes a thick film layer 86 providing the flow feature member containing a fluid chamber 120 and fluid supply channel 122. The thick film layer 86 may also be made of a cross-linked epoxy material as set forth above. However, the thick film layer 86 has a thickness ranging from about 4 to about 40 microns or more. As with the polymeric layer 108, the thick film layer overlaps a portion of the micro-fluid ejection actuator 98 as shown in FIGS. 9 and 10. The overlapped portion, adjacent the distal edge 106 may also be less than about five microns and may range from about one to about four microns.

The thick film layer 86 may be made of the same material as the polymeric layer 108; in which case there may be no need for a separate polymeric layer 108 between the thick film layer 86 and the conductive layer 96 and protective layers 100 and 102. The thick film layer 86 may be applied in the same manner as the polymeric layer 108 described above. Each of the polymeric layer 108 and thick film layer 86 may be photoimaged and developed using conventional photoimaging and developing techniques to provide the less than five micron overlap of the actuator 98. In the case of the thick film layer 86, the photoimaging and developing techniques may also be used to provide the fluid chamber 120 and fluid supply channel 122 therein.

After imaging and developing the thick film layer 86, a nozzle plate 88 made of a polyimide material or a photoresist material may be attached to the thick film layer 86. In the case of a polyimide nozzle plate 88, a nozzle 124 for each of the actuators may be laser ablated in the nozzle plate 88. If the nozzle plate 88 is made of a photoresist material, photoimaging and developing techniques may be used to make the nozzle 124.

In another alternative embodiment, illustrated in FIGS. 9 and 10, a polymeric layer 126 may overlap a proximal edge 128 of the actuator 98 so that both the distal edge 106 and the proximal edge 128 of the actuator 98 are overlapped less than about five microns, typically from about one to about four microns. The polymeric layer 126, as illustrated in FIGS. 9 and 10, may likewise be applied to overlap the proximal edge 128 of the actuator illustrated in FIGS. 6 and 7. In the embodiment illustrated in FIGS. 9 and 10, the polymeric layer 126 may be the same as the thick film layer 86 except that the thickness of the polymeric layer 126 will be reduced in the fluid supply channel 122 of the ejection head 84 by imaging and developing the polymeric layer 126.

Figure 11:
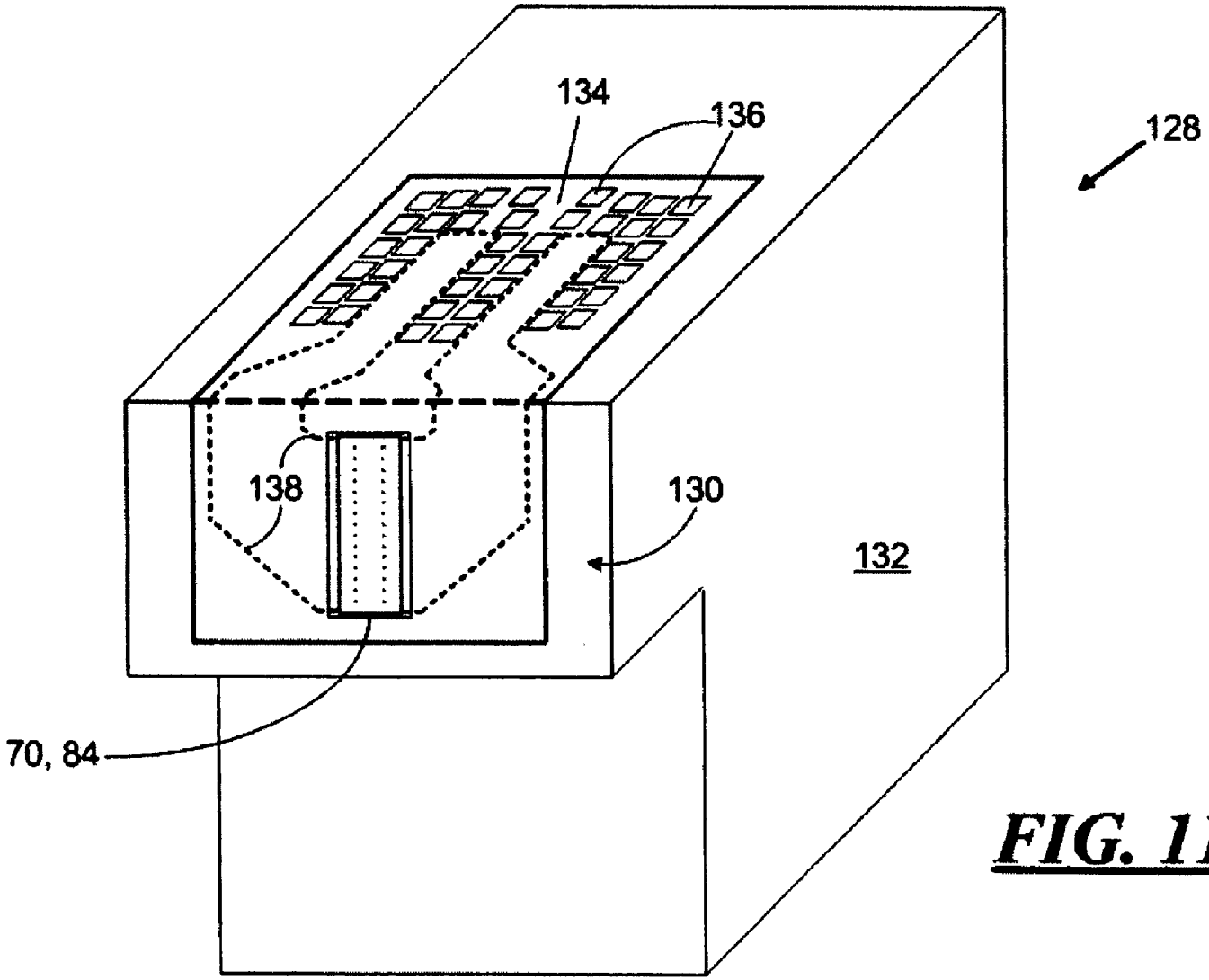
FIG. 11 is a perspective view, not to scale, of a fluid cartridge for a micro-fluid ejection head according to the disclosure.

The micro-fluid ejection head 70 or 84 may be permanently or removably attached to a fluid supply cartridge 128 as shown in FIG. 11. As shown in FIG. 5, the ejection head 70 or 84 may be attached to an ejection head portion 130 of the fluid cartridge 128. A main body 132 of the cartridge 128 includes a fluid reservoir for supply of fluid to the micro-fluid ejection head 70 or 84. A flexible circuit or tape automated bonding (TAB) circuit 134 containing electrical contacts 136 for connection to an ejection head control device, such as an ink jet printer, is attached to the main body 132 of the cartridge 128. Electrical tracing 138 from the electrical contacts 136 are attached to the substrate 76 (FIGS. 6 and 9) to provide activation of micro-fluid ejection actuator 98 on demand from the control device to which the fluid cartridge 128 is attached. The disclosure, however, is not limited to the fluid cartridges 128 as illustrated in FIG. 11 as the micro-fluid ejection head 70 or 84 according to the disclosure may be used for a wide variety of fluid cartridges, wherein the ejection head 70 or 84 may be remote from the fluid reservoir of main body 128.

It is contemplated, and will be apparent to those skilled in the art from the preceding description and the accompanying drawings, that modifications and changes may be made in the embodiments of the disclosure. Accordingly, it is expressly intended that the foregoing description and the accompanying drawings are illustrative of exemplary embodiments only, not limiting thereto, and that the true spirit and scope of the present disclosure be determined by reference to the appended claims.

What is claimed is:

1. A micro-fluid ejection head, comprising:

a substrate having a plurality of thermal ejection actuators disposed thereon, each of the thermal ejection actuators including a resistive layer and a protective layer for protecting a surface of the resistive layer, the resistive layer and the protective layer together defining an actuator stack thickness;

a flow feature member adjacent the substrate defining a fluid feed channel, a fluid chamber associated with at least one of the thermal ejection actuators and in flow communication with the fluid feed channel, and a nozzle, wherein the nozzle is offset to a side of the fluid chamber opposite the fluid feed channel; and a polymeric layer having a degradation temperature of less than about 400° C. overlapping a portion of the at least one thermal ejection actuator associated with the fluid chamber and positioned less than about five microns from at least an edge of the at least one actuator opposite the fluid feed channel.

2. The micro-fluid ejection head of claim 1, wherein the actuator stack thickness ranges from about 1200 to about 6500 Angstroms and provides an ejection energy per unit volume of from about 2 to about 4 gigajoules per cubic meter.

3. The micro-fluid ejection head of claim 1, wherein the resistive layer has a thickness ranging from about 300 to about 1000 Angstroms.

4. The micro-fluid ejection head of claim 1, wherein each of the thermal ejection actuators has a fluid heating area ranging from about 200 square microns to about 1200 square microns.

5. The micro-fluid ejection head of claim 1, wherein the protective layer has a thickness ranging from about 900 to about 5500 Angstroms.

6. The micro-fluid ejection head of claim 1, wherein the resistive layer comprises a tantalum-aluminum alloy and the protective layer comprises a material selected from the group consisting of diamond like carbon, silicon doped diamond like carbon, silicon nitride, titanium, tantalum, and an oxidized metal layer.

7. The micro-fluid ejection head of claim 6, wherein the resistive layer comprises a material selected from the group consisting of tantalum-aluminum (TaAl), tantalum-nitride (TaN), tantalum-aluminum-nitride (TaAl:N), and composite layers of tantalum and tantalum-aluminum (Ta+TaAl).

8. The micro-fluid ejection head of claim 1, wherein the polymeric layer comprises a cross-linked epoxy material.

9. The micro-fluid ejection head of claim 1, wherein the polymeric layer overlaps an edge of the at least one actuator in an amount ranging from about 1 to about 4 microns.

10. The micro-fluid ejection head of claim 1, wherein the polymeric layer overlaps the at least one ejection actuator adjacent opposing edges thereof in an amount ranging from about 1 to about 4 microns.

11. The micro-fluid ejection head of claim 1, wherein the actuators are elongate actuators having a length to width ratio ranging from about 1.5:1 to about 5:1.

12. A method for extending a life of a thermal ejection actuator for a micro-fluid ejection head comprising a substrate having a plurality of thermal ejection actuators and a protective layer therefor deposited thereon, and having a flow feature member defining a fluid feed channel, a fluid chamber associated with at least one of the thermal ejection actuators and in flow communication with the fluid feed channel, and a nozzle, wherein the nozzle is offset to a side of the fluid chamber distal from the fluid feed channel, the method comprising:

depositing a polymeric layer having a degradation temperature of less than about 400° C. in overlapping relationship with at least a portion of the at least one thermal ejection actuator, wherein the polymeric layer overlaps less than about five microns of the at least one actuator adjacent an edge thereof distal from the fluid feed channel.

13. The method of claim 12, wherein the flow feature member comprises a polymeric thick film layer.

14. The method of claim 13, wherein the act of depositing a polymeric layer provides the polymeric thick film layer.

15. The method of claim 12, wherein the flow feature member comprises a unitary polyimide member having fluid feed channels, fluid chambers, and nozzles.

16. The method of claim 15, wherein the polymeric layer comprises a planarization layer having a thickness ranging from about 1 to about 6 microns.

17. The method of claim 16, wherein the planarization layer comprises a cross-linked epoxy material.

18. The method of claim 12, wherein the polymeric layer is deposited so that the polymeric layer overlaps opposing edge portions of the at least one actuator.

19. The method of claim 18, wherein the polymeric layer is deposited on the at least one actuator so that the overlapped portions extend from about 1 to about 4 microns from the opposing edge portions thereof.

20. A micro-fluid ejection head made by the method of claim 12.

* * * * *